United States Patent [19]

Brandt et al.

[11] Patent Number: 4,509,417

[45] Date of Patent: Apr. 9, 1985

[54] APPARATUS FOR EXPELLING AIR FROM STACKS OF PAPER SHEETS OR THE LIKE

[75] Inventors: Eckhard Brandt, Norderstedt; Wolfram Wolf, Bilsen, both of Fed. Rep. of Germany

[73] Assignee: E.C.H. Will (GmbH & Co.), Hamburg, Fed. Rep. of Germany

[21] Appl. No.: 576,205

[22] Filed: Feb. 2, 1984

[30] Foreign Application Priority Data

Feb. 12, 1983 [DE] Fed. Rep. of Germany ..... 3304955

[51] Int. Cl.[3] ..... B30B 9/00

[52] U.S. Cl. ..... 100/90; 100/144; 100/153; 100/156; 100/176; 100/211; 100/265; 100/295; 414/907

[58] Field of Search ..... 100/153, 156, 90, 211, 100/144, 155 R, 176, 265, 295, 233, 173; 271/85, 84; 414/115, 43, 907

[56] References Cited

U.S. PATENT DOCUMENTS

| | | | |
|---|---|---|---|
| 588,125 | 8/1897 | Bundren | 100/156 |
| 965,336 | 7/1910 | Schmidt | 100/153 |
| 2,030,527 | 2/1936 | Meyer | 100/156 X |
| 3,257,110 | 6/1966 | Smethurst | 100/153 X |
| 3,515,056 | 6/1970 | Johnson | 100/153 X |
| 4,297,066 | 10/1981 | Ramcke | 414/115 X |

*Primary Examiner*—Billy J. Wilhite

*Attorney, Agent, or Firm*—Peter K. Kontler

[57] ABSTRACT

Apparatus for expelling air from pockets between superimposed sheets of successive stacks has a brush or roller which can be lowered onto the topmost sheet of a stack while the leader of the stack is pulled along a stationary support by a tongs. The brush or roller urges successive increments of the lowermost sheet of the moving stack against a stationary or rotary anvil whereby the pockets of air are eliminated in automatic response to forward movement of the stack with the tongs. Expulsion of air from the stacks enhances their shape-retaining ability during transport toward the next processing station or stations as well as at such stations. The brush or roller is mounted on pivotable arms which can be rocked back and forth by one or more levers which are pivotable by a cam and follower assembly receiving motion from the main prime mover of the machine or production line wherein the stacks are formed and/or processed.

14 Claims, 4 Drawing Figures

APPARATUS FOR EXPELLING AIR FROM STACKS OF PAPER SHEETS OR THE LIKE

BACKGROUND OF THE INVENTION

The present invention relates to apparatus for maintaining stacks of superimposed sheets which consist of paper or the like. More particularly, the invention relates to apparatus for treating stacked sheets of paper or the like preparatory to or during transport to packing or other processing stations.

It is well known that stacks of superimposed sheets tend to undergo more or less pronounced deformation during transport from the stacking station or stations to the processing station or stations. The tendency of stacks to undergo deformation is especially pronounced when the stacks must be diverted from their normal path, when the deflection is pronounced (e.g., through an angle of 90°), and/or when the stacks are abruptly accelerated or decelerated irrespective of whether such changes in speed take place during movement along a straight path or during deflection from such path. If the configuration of a stack departs from its optimum (normally parallelepiped) shape, the stack is not likely to fit into a receptacle or it cannot be properly processed to form part of or to constitute a steno pad, an exercise book or another stationery product. For example, if one marginal portion of a stack of overlapping paper sheets is formed with a row of holes for introduction of a helical binder which is made of wire or the like, the binder cannot be introduced into the holes in an automatic machine if the sheets of the stack are not in accurate register with one another.

It has been found that a major cause of the tendency of paper sheets in a stack to move relative to one another is that the stack contains pockets of air which are entrapped between certain neighboring sheets and act not unlike layers of lubricant by facilitating the movements or by promoting the tendency of sheets which flank an air pocket to move relative to each other. As a rule, at least a certain percentage of entrapped air will escape with time. However, the damage is normally done before the escape of appreciable quantities of air is completed, especially in a modern high-speed paper processing machine wherein the intervals for transport of successively assembled stacks from the stacking station to the next processing station are very short. Furthermore, it is normally desirable to locate the first processing station close or very close to the stacking station; this also reduces the length of intervals which are available for spontaneous escape of air from pockets between certain sheets of the stack.

OBJECTS AND SUMMARY OF THE INVENTION

An object of the invention is to provide an apparatus which promotes the escape of air from between the sheets of stacked paper sheets or the like.

Another object of the invention is to provide an air expelling apparatus which occupies little room, which is of simple construction, whose operation is highly reliable, which can be designed to expel air from tall or short, wide or narrow stacks, and which can be installed in existing production lines for the making of stationery products.

A further object of the invention is to provide an apparatus which can reliably expel air from an entire stack of superimposed paper sheets while such stack advances along its normal path so that it is not necessary to prolong the path of paper stacks for the express purpose of expelling air therefrom.

An additional object of the invention is to provide an apparatus which can be readily converted for the treatment of different formats of stacks and which can treat successive stacks with a required degree of firmness so as to expel all or nearly all of the entrapped air without defacing or otherwise adversely affecting the appearance and/or quality of the stacks.

Still another object of the invention is to provide an apparatus which can expel air from successive stacks at a high or low frequency, depending on the output of the stacking devices and/or the requirements of machines which received deaerated stacks, and which can stabilize the stacks preparatory to their packing and/or other treatment.

The invention is embodied in an apparatus for maintaining stacks of superimposed sheets of paper or the like wherein pockets of entrapped air are likely to develop between neighboring sheets. The apparatus comprises a preferably stationary support for the lowermost sheet of each of a series of stacks, means for transporting successive stacks of the series away from the support in a predetermined direction (such transporting means can comprise a tongs which is arranged to engage the leader of a stack on the support, as considered in the aforementioned direction, and to thereupon pull the thus engaged stack in such direction), and means for expelling air (if any) from between the sheets of successively removed stacks. The air expelling means comprises a pressure applying device and means for moving such device into engagement with the topmost sheet of the stack on the support so that the pressure applying device exerts upon the topmost sheet a requisite pressure at least substantially all the way across the stack, as considered transversely of the direction of transport, while the stack is being transported away from the support whereby the topmost sheet slides with reference to the pressure applying device and the latter squeezes air from the pockets (if any) between the sheets of the moving stack.

The moving means can comprise means for pivoting the pressure applying device between a retracted position and a position of engagement with the topmost sheet of the stack on the support. To this end, the moving means can comprise a carrier (e.g., an elongated horizontal bar) for the pressure applying device. The carrier extends transversely of the direction of transport of successive stacks, and its end portions are disposed at the opposite sides of the path of movement of stacks relative to the support. The moving means further comprises a pair of arms each of which is connected to a different end portion of the carrier, and pivot means defining for the arms a common pivot axis (such pivot axis is preferably horizontal and normal to the direction of transport of stacks). The moving means further comprises means for pivoting the arms about the common axis, and such pivoting means can comprise a lever, means for rocking the lever and means for coupling the lever to one of the arms. The rocking means can comprise a cam and follower assembly which receives motion from the main prime mover of the machine or production line embodying the improved apparatus.

The apparatus can further comprise a back support or anvil which is adjacent to the lowermost sheet of the stack whose uppermost sheet is engaged by the pressure applying device. Such anvil preferably extends substantially transversely of the direction of transport of stacks, and the pressure applying device is preferably located opposite the anvil while the pressure applying device engages the topmost sheet of a moving stack. The anvil can constitute or it comprises an elongated strip or bar which is fixedly mounted in or on the support (the strip can constitute an integral part of the support). Alternatively, the anvil can comprise a one-piece or composite roller which is rotatable with reference to the support as a result of movement of the lowermost sheet of a stack therealong.

The pressure applying device can constitute an elongated brush. It is also possible to employ a pressure applying device which constitutes a roller. Such roller can have a layer of elastomeric material which is adjacent to its peripheral surface. Alternatively, the roller can consist, either entirely or in part, of steel or another metallic material.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
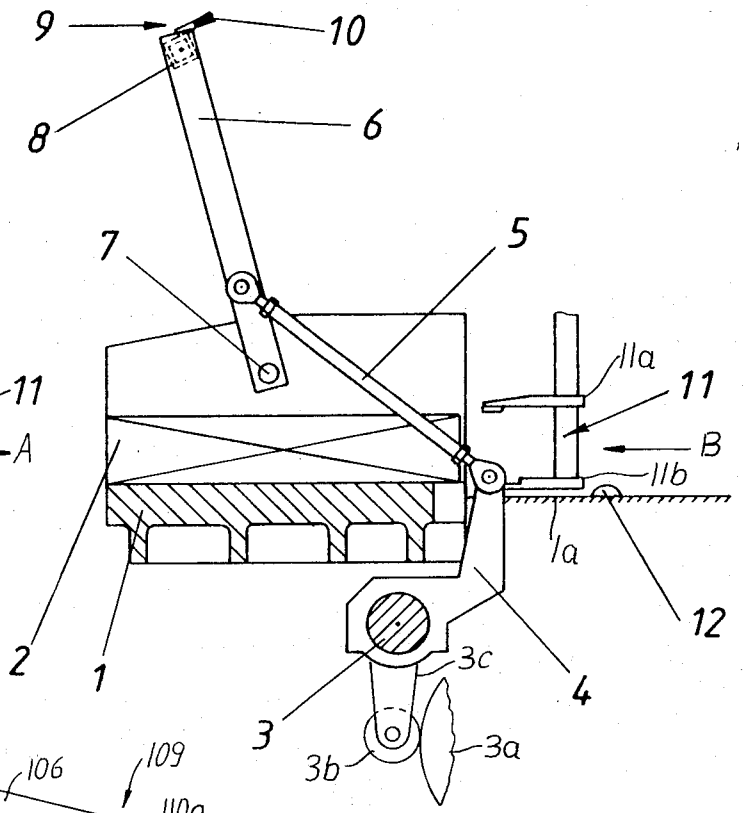
FIG. 1 is a somewhat schematic partly side elevational and partly longitudinal vertical sectional view of an apparatus which embodies one form of the invention, the pressure applying device being shown in retracted position.
Figure 2:
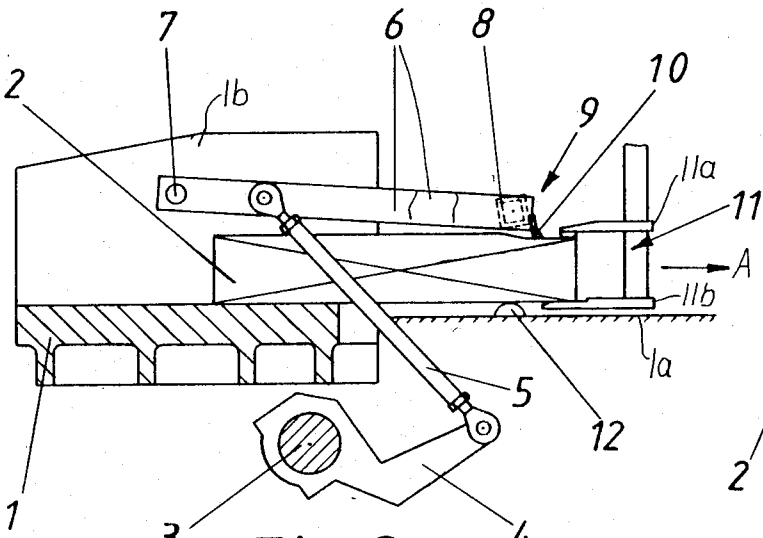
FIG. 2 illustrates the apparatus of FIG. 1 but with the pressure applying device in engagement with the topmost sheet of a moving stack.

The apparatus which is shown in FIGS. 1 and 2 comprises a stationary support including a platform 1 and an extension 1*a* whose upper side is located at a level slightly below the upper side of the platform. A stack 2 rests on the platform 1; such stack can be formed directly on the support or it can be delivered thereto in the direction indicated by arrow A. This stack is assumed to contain one or more pockets of air which are entrapped between its sheets. In FIG. 1, the lowermost sheet of the stack 2 rests on the upper side of the platform 1, and the top sheet of such stack is exposed.

The air expelling means of the apparatus which is shown in FIGS. 1 and 2 comprises a pressure applying device 9 which includes an elongated brush 10 extending transversely of the direction of transport of stacks 2 away from the support including the platform 1 and its extension 1*a* (such direction coincides with that which is indicated by the arrow A). The air expelling means further comprises means for moving the brush 10 between the retracted position of FIG. 1 and an operative position which is shown in FIG. 2 and in which the bristles of the brush 10 bear upon the topmost sheet of the stack 2 with a preselected force while the stack is being transported away by a tongs 11 which engages the leader of the stack 2, as considered in the direction of arrow A, and moves the stack away from the platform 1. The direction in which the tongs 11 is moved toward a position of engagement with a fresh stack 2 on the platform 1 is indicated by the arrow B.

The means for moving the brush 10 between the positions of FIGS. 1 and 2 comprises an elongated horizontal carrier 8 (e.g., a hollow polygonal bar whose end portions are disposed at the opposite sides of the path of movement of stacks 2 away from the support), two arms 6 which are connected with the end portions of the carrier 8, and pivot means 7 defining a stationary axis for those end portions of the arms which are remote from the respective end portions of the carrier 8. The pivot means 7 are mounted in upwardly extending sidewalls or cheeks 1*b* of the platform 1 (FIGS. 1 and 2 merely show one of these sidewalls because the other sidewall is located in front of the plane of the drawing). The means for pivoting the arms back and forth about the common axis which is defined by the pivot means 7 comprises a lever 4 which is secured to a shaft 3 and is articulately coupled to one of the arms 6 by a link 5. A second lever 4 and a second link 5 is preferably provided for the other arm 6. The means for rocking the shaft 3 back and forth (i.e., clockwise and counterclockwise, as viewed in FIGS. 1 and 2) comprises a cam and follower assembly 3*a*, 3*b*. The cam 3*a* is preferably a rotary disc cam or cylinder cam which receives motion from the main prime mover (not shown) of the machine or production line embodying the improved apparatus, and the follower 3*b* can be mounted on an arm 3*c* of the shaft 3. Other means for rocking the shaft 3 and its lever or levers 4 can be used with equal or similar advantage.

The manner in which the tongs 11 is movable in the directions indicated by the arrows A and B forms no part of the invention. Reference may be had, for example, to commonly owned U.S. Pat. No. 4,297,066 granted Oct. 27, 1981 to Bernd Ramcke et al. This patent further shows suitable cam and follower assemblies suitable to rock the lever or levers 4 in order to move the brush 10 between the positions of FIGS. 1 and 2.

The brush 10 extends across the full width of the stack 2 on the platform 1. The length of the link or links 5 is preferably adjustable so that it is possible to select the pressure which the bristles of the brush 10 apply to the topmost sheet of the stack 2 which is in the process of being transported by the tongs 11.

In the position of FIG. 1, the brush 10 is located well above the path of stacks so that is does not interfere with the accumulation of discrete sheets or groups of sheets into a full stack or with the delivery of a fresh stack onto the platform 1. When the tongs 11 reaches its left-hand end position and its jaws 11*a*, 11*b* properly engage the leader of the freshly formed or freshly delivered stack 2, the mechanism for reciprocating the tongs 11 causes the latter to move in the direction of arrow A and to pull the engaged stack 2 off the platform 1. The lowermost sheet of such stack slides along the upper side of the platform 1 on its way toward a position of overlap with the upper side of the extension 1*a*. At such time, the cam and follower assembly 3*a*, 3*b* causes the lever or levers 4 to pivot the arms 6 from the positions of FIG. 1 to the positions of FIG. 2 whereby the bristles of the brush 10 engage the topmost sheet of the stack 2 immediately or closely behind the upper jaw 11*a* of the tongs 11 and the topmost sheet slides relative to the bristles while the stack 2 advances in the direction which is indicated by the arrow A. The fact that the bristles of the brush 10 do not engage the leading edge of the topmost sheet of the stack 2 is of no consequence because the air-expelling action of the jaws 11*a* and 11*b* is sufficient to ensure predictable and reliable expulsion of air from the pockets (if any) between the sheets in the leader of the stack.

FIGS. 1 and 2 further show a stationary back support or anvil 12 which is an elongated strip or bar extending transversely of the direction of transport of the stack 2 at a level below the lowermost sheet of the stack and opposite the brush 10 (when the latter is held in the operative position of FIG. 2). The anvil 12 cooperates with the bristles of the brush 10 to promote expulsion of air from between the sheets of the stack 2 while the stack is pulled by the tongs 11 along the extension 1*a* of the stationary support. The anvil 12 can form an integral part of the extension 1*a*.

It has been found that the improved apparatus reliably expels at least the major percentage of air which happens to be entrapped between neighboring sheets of the stack 2. Moreover, the apparatus occupies little room and such room is invariably available in machines which accumulate and process stacks of paper sheets or the like. Still further, the bristles of the brush 10 treat the topmost sheets of a series of stacks 2 gently, the same as the anvil 12 which is preferably formed with a convex external surface that comes into actual contact with the lowermost sheets of successive stacks. Another important advantage of the improved apparatus is that the expulsion of air from successive stacks can be completed in a small area and while the stacks are in motion from the stacking station or a stack receiving station to the next processing station, e.g., to a packing station. All that is necessary is to lower the brush 10 to the position of FIG. 2 and to move a stack through a distance which equals or approximates its length so that the major part of the topmost sheet can advance along and past the bristles. The air escapes laterally at both sides of the moving stack as well as rearwardly, and the air-expelling action is sufficiently pronounced to greatly reduce the likelihood of misalignment of neighboring sheets during further processing of the stacks. As mentioned above, the pockets of air between neighboring sheets of a stack of paper sheets or the like act not unlike layers of lubricant and greatly enhance the tendency of sheets to slide relative to one another.

Figure 3:
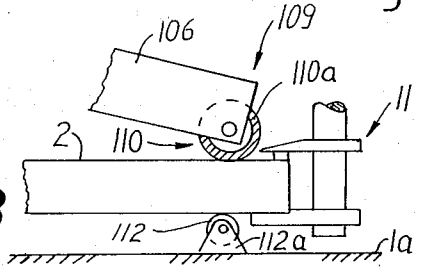
FIG. 3 is a fragmentary partly elevational and partly longitudinal vertical sectional view of a modified apparatus.
Figure 4:
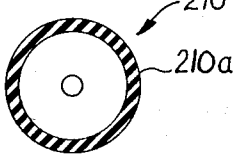
FIG. 4 is a partly elevational and partly sectional view of a modified roller for use in the apparatus of FIG. 3.

The improved apparatus is susceptible of many modifications without departing from the spirit of the invention. For example, and as shown in FIG. 3, the pressure applying device 109 can comprise an idler roller 110 which is rotatably mounted in the end portions of the arms 106 and has a smooth cylindrical peripheral surface. Such peripheral surface can be the external surface of a layer 110*a* of metallic material (e.g., steel) or a layer 210*a* of elastomeric material (note the roller 210 of FIG. 4), i.e., the entire roller or a portion of the roller can be made of a rigid metallic or a yieldable elastomeric material.

FIG. 3 further shows that the stationary anvil of FIGS. 1 and 2 can be replaced with a roller-shaped anvil 112 whose end portions are journalled in bearings installed in brackets 112*a* which are provided therefor on the extension 1*a* of the support. The material of the anvil 112 may be rigid or elastomeric. This anvil or the anvil 12 of FIGS. 1–2 cooperates with the brush 10 or roller 110 to squeeze out any air from the spaces between neighboring sheets of successived stacks while the stacks are in the process of leaving the support including the platform 1 and its extension 1*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating stacks of superimposed sheets of paper or the like wherein pockets of entrapped air are likely to develop between neighboring sheets, comprising a support for the lowermost sheet of each of a series of successive stacks; means for transporting successive stacks of the series away from said support in a predetermined direction; and means for expelling air from between the sheets of successively transported stacks, including a pressure applying device and means for moving said device into engagement with the topmost sheet of the stack on said support so that said device exerts upon the topmost sheet a requisite pressure at least substantially all the way across the stack, as considered transversely of said direction, while the stack is being transported away from said support whereby the topmost layer moves with reference to said pressure applying device.

2. The apparatus of claim 1, wherein said moving means comprises means for pivoting said device between a retracted position and a position of engagement with the topmost sheet of the stack on said support.

3. The apparatus of claim 1, wherein said moving means comprises a carrier for said device, said carrier extending transversely of said direction and having end portions at the opposite sides of the path of movement of stacks away from said support, a pair of arms each connected to one of said end portions, and pivot means defining a common pivot axis for said arms, said pivot axis extending transversely of said direction.

4. The apparatus of claim 3, wherein said moving means further comprises means for pivoting said arms about said axis including a lever, means for rocking said lever, and means for coupling said lever with one of said arms.

5. The apparatus of claim 4, wherein the means for rocking said lever comprises cam and follower means.

6. The apparatus of claim 1, further comprising an anvil adjacent to the lowermost sheet of the stack whose uppermost sheet is engaged by said device, said anvil extending substantially transversely of said direction and said device being located opposite said anvil while engaging the topmost sheet of a stack on said support.

7. The apparatus of claim 6, wherein said anvil comprises a strip fixedly mounted on said support.

8. The apparatus of claim 6, wherein said anvil comprises a roller which is rotatable with reference to said support.

9. The apparatus of claim 1, wherein said transporting means comprises a tongs arranged to engage the leader of a stack on said support, as considered in said direction, and to thereupon pull the thus engaged stack in said direction.

10. The apparatus of claim 1, wherein said device includes a brush.

11. The apparatus of claim 1, wherein said device includes a roller.

12. The apparatus of claim 11, wherein said roller has a peripheral surface and a layer of elastomeric material adjacent to said peripheral surface.

13. The apparatus of claim 11, wherein said roller has a peripheral surface and a layer of metallic material adjacent to said surface.

14. The apparatus of claim 13, wherein said layer consists of steel.

* * * * *